US010060611B2

(12) United States Patent
Liu

(10) Patent No.: US 10,060,611 B2
(45) Date of Patent: Aug. 28, 2018

(54) ILLUMINATION LINKAGE UNIT AND LINEAR ILLUMINATION THEREOF

(71) Applicant: Dingzhang Liu, Shenzhen (CN)

(72) Inventor: Dingzhang Liu, Shenzhen (CN)

( * ) Notice: Subject to any disclaimer, the term of this patent is extended or adjusted under 35 U.S.C. 154(b) by 416 days.

(21) Appl. No.: 14/905,254

(22) PCT Filed: May 26, 2015

(86) PCT No.: PCT/CN2015/079751

§ 371 (c)(1),
(2) Date: Jan. 14, 2016

(87) PCT Pub. No.: WO2016/110041

PCT Pub. Date: Jul. 14, 2016

(65) Prior Publication Data

US 2016/0195253 A1 Jul. 7, 2016

(30) Foreign Application Priority Data

Jan. 7, 2015 (CN) ..... 2015 2 0009046 U

(51) Int. Cl.

| | |
|---|---|
| ***F21V 21/00*** | (2006.01) |
| ***F21V 23/06*** | (2006.01) |
| ***F21S 4/00*** | (2016.01) |
| ***F21S 4/20*** | (2016.01) |

(Continued)

(52) U.S. Cl.
CPC ..... *F21V 23/06* (2013.01); *F21S 4/20* (2016.01); *F21V 23/02* (2013.01); *F21V 31/005* (2013.01);

(Continued)

(58) Field of Classification Search
CPC ..... F21V 23/06; F21V 23/02; F21V 31/005; F21V 21/00; F21S 4/20; F21S 4/00; F21Y 2115/10; H01R 13/622

(Continued)

(56) References Cited

U.S. PATENT DOCUMENTS 5,150,964 A 9/1992 Tsui
5,474,467 A * 12/1995 Chen ..... F21V 21/002 439/417

(Continued)

FOREIGN PATENT DOCUMENTS

CN 2135718 6/1993
CN 2273088 1/1998

(Continued)

OTHER PUBLICATIONS

International Search Report of PCT/CN20151079751, dated Sep. 25, 2015, 11 pages total.

*Primary Examiner* — Brandon S Cole
(74) *Attorney, Agent, or Firm* — Hamre, Schumann, Mueller & Larson, P.C.

(57) ABSTRACT

The application is applicable to the field of illuminations and discloses an illumination linkage unit, which comprises a wire assembly and an illuminating member; the wire assembly comprises a positive wire, a negative wire, and a return wire; the positive wire and the negative wire are arranged in pairs, and there are multiple spaced electrical linkage groups formed between the positive wire and the negative wire; each illuminating member is provided therein with an electrical linkage group; each former electrical linkage group is connected in series or in parallel with its later electrical linkage group; the return wire extends from a first electrical linkage group to a last electrical linkage group; the positive wire of the first electrical linkage group and the return wire are electrically connected to a first connection head, and the negative wire of the last electrical linkage group and the return wire are electrically connected to a second connection head; the second connection head is connected with a function head. The illumination linkage units disclosed by the application possess an even brightness and a consistent light-and-dark level. Heating phenomenon will not occur, (Continued)

and the connection between the illumination linkage units is convenient, stable and reliable, thereby ensuring the convenience to use the linear illumination.

15 Claims, 4 Drawing Sheets

(51) Int. Cl.

| | |
|---|---|
| ***F21V 23/02*** | (2006.01) |
| *F21V 31/00* | (2006.01) |
| *H01R 13/622* | (2006.01) |
| *F21Y 115/10* | (2016.01) |

(52) U.S. Cl.
CPC ..... *F21Y 2115/10* (2016.08); *H01R 13/622* (2013.01)

(58) Field of Classification Search
USPC ..... 315/32–75; 362/227–311.15
See application file for complete search history.

(56) References Cited

U.S. PATENT DOCUMENTS

| | | | | |
|---|---|---|---|---|
| 5,590,952 | A * | 1/1997 | Cheng | F21V 3/04 362/123 |
| 6,367,952 | B1 * | 4/2002 | Gibboney, Jr. | F21V 19/0005 362/249.05 |
| 8,608,342 | B2 * | 12/2013 | Chen | H01L 23/495 362/249.01 |
| 2012/0075863 | A1 | 3/2012 | Chen | |
| 2016/0195253 | A1 * | 7/2016 | Liu | F21V 23/06 362/650 |

FOREIGN PATENT DOCUMENTS

| | | |
|---|---|---|
| CN | 2413167 | 1/2001 |
| CN | 2502120 | 7/2002 |

* cited by examiner

ILLUMINATION LINKAGE UNIT AND LINEAR ILLUMINATION THEREOF

FIELD OF THE APPLICATION

The application relates to the field of illuminations, specifically to an illumination linkage unit and a linear illumination thereof.

BACKGROUND OF THE APPLICATION

Illuminations have become the first choice to increase the festival atmosphere during a festival, because they have various shapes, flickering colors, and great illuminative and decorative effects in the night. Most current illuminations are comprised of multiple illuminations with various colors concatenated together, and powered by power supplies through driving circuits to illuminate. These kinds of illuminations can meet the requirements of the users to a certain extent.

However, when an existing illumination is elongated, the brightness level of each bead of the illumination may be not even, and light-and-dark inconsistency among the beads may be caused. Furthermore, beads close to a driving power supply will produce severe heat, and affect the safety and reliability of the whole illumination. Additionally, when illuminations are elongated, a connection between two elongated illuminations may be inconvenient and unstable, causing an unreliable electrical connection.

SUMMARY OF THE APPLICATION

The application aims at overcoming the defects in the prior art, and provides an illumination linkage unit, of which the brightness of each bead is even, the brightness of all beads is consistent, and heating phenomenon will not occur. A connection between such illumination linkage units is convenient and stable, and an electrical connection between such illumination linkage units is reliable.

The application is realized by the following technical solution: an illumination linkage unit, which comprises a wire assembly and an illuminating member electrically connected to the wire assembly. The wire assembly comprises at least one positive wire, at least one negative wire, and at least one return wire. The positive wire and the negative wire are arranged in pairs, and there are multiple spaced electrical linkage groups formed between the positive wire and the negative wire. Each former electrical linkage group is connected in series or in parallel with its later electrical linkage group. The return wire extends from the first electrical linkage group to the last electrical linkage group, and is electrically connected with the negative wire of the last electrical linkage group. Each illuminating member is provided therein with an electrical linkage group; the each illuminating member provided in the electrical linkage group is electrically connected to the positive wire and negative wire respectively. The positive wire of the first electrical linkage group and the return wire are electrically connected to a first connection head, and the negative wire of the last electrical linkage group and the return wire are electrically connected to a second connection head which is matchable and connectable with the first connection head. The second connection head is detachably connected with a function head configured to connect the negative wire with the return wire.

Specifically, the positive wire, the negative wire and the return wire are lined side by side in bundle.

Furthermore, an adhesive layer configured to adhere the positive wire, the negative wire and the return wire together is arranged among the positive wire, the negative wire and the return wire.

Preferably, the illuminating member is an LED bead.

Specifically, the first connection head is provided with a connection body and a first conductive group arranged inside the connection body; the second connection head is provided with a connection cap and a second conductive group arranged inside the connection cap and electrically connected in a pluggable way with the first conductive group; a connection component configured to detachably connect the connection body with the connection cap is arranged between the connection body and the connection cap.

Specifically, the connection component is provided with a first external thread arranged on the connection body and a first inner thread arranged on the connection cap; the first external thread is connected with the first inner thread.

Specifically, the connection component is provided with at least two fixture blocks arranged on the connection body and at least two fixture hooks arranged on the connection cap; the fixture hooks are hooked on the fixture blocks.

Preferably, the number of the fixtures is three, the number of the fixture hooks is also three, and the fixture blocks and the fixture hooks are arranged equidistantly.

Specifically, the function head is configured with a second external thread which is threadedly matchable and connectable with the first inner thread arranged on the connection cap.

Specifically, the function head is provided thereon with a hanging hook configured to hook the fixture blocks.

Furthermore, the second conductive group is sheathed with a sealing ring for waterproofing.

Furthermore, the illumination linkage unit further includes a transparent soft protective jacket; the wire is sleeved in the transparent soft protective jacket.

Specifically, peripheries of the positive wire, the negative wire and the return wire are all provided with protective layers for insulation.

Specifically, the illuminating member is covered with sealant.

The application further provides a linear illumination, which comprises a driving power supply configured to drive the illumination linkage unit to illuminate, and further comprises the above-mentioned illumination linkage unit; the driving power supply is provided therein with a constant current component, and the driving power supply is further provided with a power supply connection head detachably connected with the first connection head electrically.

The illumination linkage unit provided by the application sets the wire assembly as comprising at least one positive wire, at least one negative wire, and at least one return wire. Multiple spaced electrical linkage groups are formed between the positive wire and the negative wire. Furthermore, the negative wire of each former electrical linkage group is connected to the positive wire of its later electrical linkage group; the negative wire of the last electrical linkage group is connected to the return wire. In this way, the current values of the illuminating members inside each electrical linkage group are equal, thereby ensuring that the illuminative brightness of each illuminating member is even. Furthermore, the arrangement of the first connection head and the second connection head can improve the convenience of connections with other illumination linkage units, and the connection stability is good, thereby ensuring the reliability of the electrical connections between such illumination linkage units.

The application further provides a linear illumination, which is formed by connecting the above-mentioned illumination linkage units together. It is convenient to connect the illumination linkage units thereof and the electrical connections between the illumination linkage units are stable and reliable. By the arrangement of the driving power supply with the constant current component, constant current can be transmitted, thereby making the current of each illuminating member in the linear illumination be equal, and ensuring even brightness levels without light-and-dark areas. Furthermore, heating sections will not occur, and the appearance and safety are improved.

DETAILED DESCRIPTION OF THE PREFERRED EMBODIMENT

Figure 1:
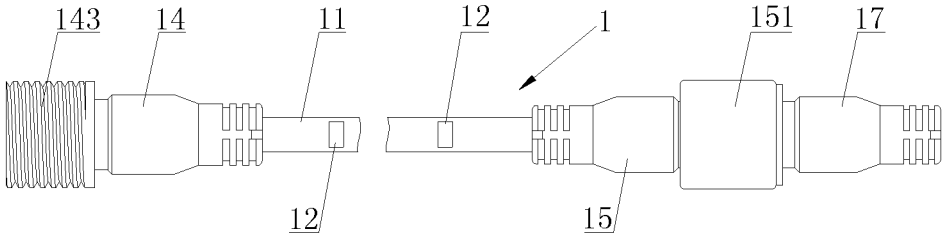
FIG. 1 is a schematic view of an illumination linkage unit provided by one embodiment of the application.

The purpose, technical solutions and advantages of the application will become more apparent with the following detailed specification in combination with the following drawings and embodiments. It should be understood that the specific embodiments described herein are merely intended to illustrate but not to limit the application.

As shown in FIGS. 1-5, one embodiment of the present application provides an illumination linkage unit 1, which comprises a wire assembly 11 and an illuminating member 12 electrically connected to the wire assembly 11. The wire assembly 11 comprises at least one positive wire 111, at least one negative wire 112, and at least one return wire 113. The positive wire 111 and the negative wire 112 are arranged in pairs, multiple spaced electrical linkage groups 13 are formed between the positive wire 111 and the negative wire 112. At least one illuminating member 12 is arranged inside each electrical linkage group 13, which illuminating member 12 is electrically connected to the positive wire 111 and the negative wire 112 respectively. Each former electrical linkage group 13 will be connected in series or in parallel with a later electrical linkage group 13 after the former electrical linkage group 13. The return wire 113 extends from the first electrical linkage group 13 to the last electrical linkage group 13, and is connected to the negative wire 112 of the last electrical linkage group 13 electrically. The positive wire 111 of the first electrical linkage group 13 and the return wire 113 are electrically connected to a first connection head 14, and the negative wire 112 of the last electrical linkage group 13 and the return wire 113 are electrically connected to a second connection head 15 which is matchable and connectable with the first connection head 14. The second connection head 15 can be detachably connected with a function head 17 which is configured to connect the negative wire 112 with the return wire 113. Since every illumination linkage unit 1 comprises a plurality of electrical linkage groups 13, and the electrical linkage groups 13 are connected in series or in parallel according to the design requirement, the negative wire 112 can be electrified from the last electrical linkage group 13 by extending the return wire 113 from the first electrical linkage group 13 to the last electrical linkage group 13 and connecting the return wire 113 to the negative wire 112 of the last electrical linkage group 13 through the connection of the function head 17. The positive wire 111 is electrified from the first electrical linkage group 13, which makes the current values of the illuminating members 12 of every electrical linkage group 13 be equal, thereby keeping each illuminating member 12 at the same brightness level and at an even light intensity. At the same time, the illumination linkage unit 1 overcomes the defect that the end thereof at which a power source is connected may be overheated, thereby ensuring the use reliability.

Figure 2:
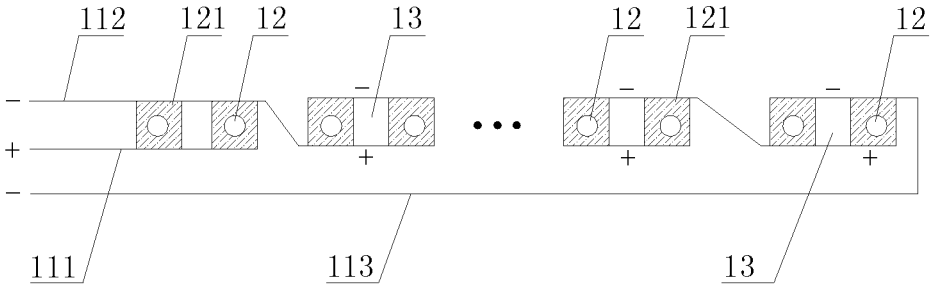
FIG. 2 is a schematic view of a connection between electrical linkage groups provided by the embodiment of the application.
Figure 3:
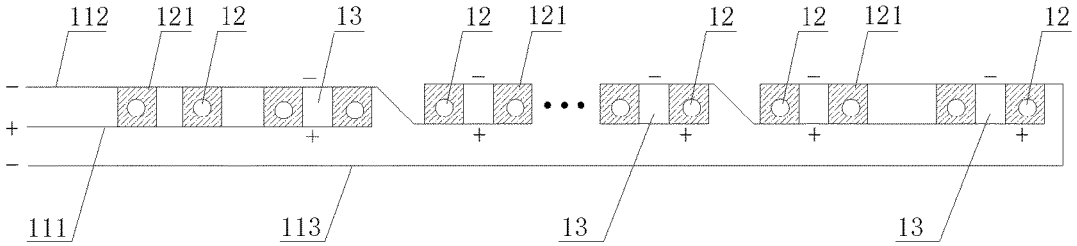
FIG. 3 is another schematic view of the connection between the electrical linkage groups provided by the embodiment of the application.

Specifically, as shown in FIG. 2 and FIG. 3, in other embodiments, according to various design requirements, each of the electrical linkage groups 13 can be connected all in series or all in parallel, or every group of the electrical linkage groups 13 are connected in parallel as a unit, and the units are connected in series; or every group of the electrical linkage groups 13 are connected in series as a unit, and the units are connected in parallel. The specific arrangement can be selected according to production needs, and do not need to be listed out and limited here.

Specifically, as shown in FIGS. 1-5, according to different using conditions, a plurality of illumination linkage units 1 may need to be connected in order to increase the illumination length. In this embodiment, in order to ensure the convenience of the connection between the illumination linkage units 1 and the reliability of the electrical connection after the unit connection, the positive wire 111 of the first electrical linkage group 13 and the return wire 113 from a group, and are electrically connected to the first connection head 14; the negative wire 112 of the last electrical linkage group 13 and the return wire 113 form a group, and are electrically connected to the second connection head 15 which is matchable and connectable with the first connection head 14. Thus, each of the illumination linkage unit 1 is provided with the first connection head 14 and the second connection head 15 at its two ends respectively. In this way, when requiring being elongated by connection, the first connection head 14 of a first illumination linkage unit 1 can be connected to an external power source, and the second connection head 15 of a first illumination linkage unit 1 can be connected to the first connection head 14 of a next illumination linkage unit 1, and so on. Such a concatenation can increase the illumination length correspondingly. The second connection head 15 of the last illumination linkage unit 1 can be connected to the function head 17, such that the return wire 113 of the last illumination linkage unit 1 is connected to the negative wire 112 of the last electrical linkage group 13, thereby constituting a conductive loop. When the loop is electrified, all the illumination linkage units 1 concatenated together will generate light.

Figure 5:
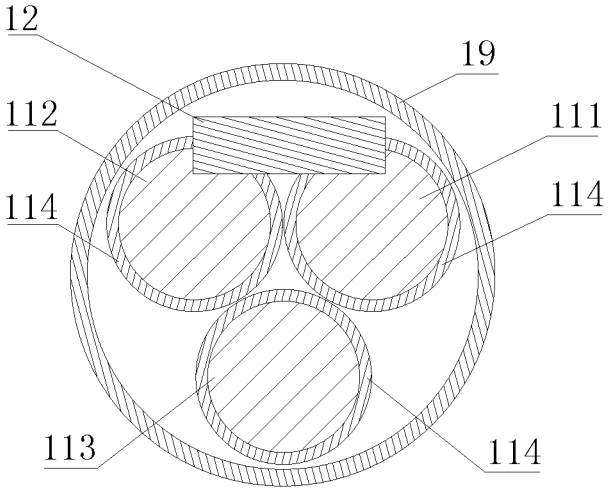
FIG. 5 is a schematic cross-sectional cut-away view of a wire provided by the embodiment of the application.

In this embodiment, the first connection head 14 and the second connection head 15 which can be connected in match improve the convenience of the connection between the illumination linkage units 1, and ensure the stability after connection, so that the use is convenient and safe. Furthermore, when there is no need to elongate, the first connection head 14 of each individual illumination linkage unit 1 can be connected to an external power source, and the second connection head 15 can be connected to the function head 17, and the illumination linkage unit 1 can still meet the need of use. Furthermore, in this embodiment; the first connection head 14 is used for connection to an external power source, and the second connection head 15 for connection to the function head 16; however, it is not the only configuration, but merely an example for explanation. It can be understood that the first connection head 14 can also be configured to be connected to the function head 17, and the second connection head 15 can also be configured to be connected to an external power source, which is not limited herein. The function head 17 is configured to connect the negative wire 112 of the last electrical linkage group 13 with the return wire 113 so as to form a conductive loop. Specifically, as shown in FIG. 1 and FIG. 5, the positive wire 111, the negative wire 112 and the return wire 113 are lined side by side in bundle. In this way, the whole wire 11 is compact in structure, which not only keeps the whole appearance but also improves the tensile strength of the wire 11, thereby solving the problem that the wire 11 is prone to be pulled apart and improving the using reliability and the service life of the whole illumination linkage unit 1.

Furthermore, an adhesive layer (not shown) configured to adhere the positive wire 111, the negative wire 112 and the return wire 113 is arranged among the positive wire 111, the negative wire 112 and the return wire 113. All wires is adhered together to form "a single string" through the adhesive layer, and thus the problem that the wires are prone to be winded during the assembly of the illuminating members 12 is solved.

Preferably, the illuminating member in the embodiment is an LED bead. The LED bead has many advantages, such as high brightness, low energy consumption, soft light, low heat dissipation, and others, therefore, it saves energy and protects the environment. Furthermore, the LED bead possesses a long service life, which ensures the reliability of the illumination linkage unit 1.

Figure 4:
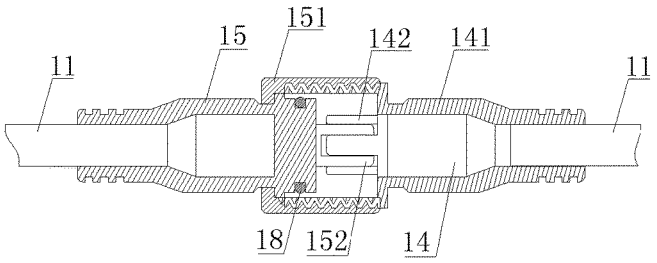
FIG. 4 is a schematic cut-away view of a connection between a first connection head and a second connection head provided by the embodiment of the application.
Figure 6:
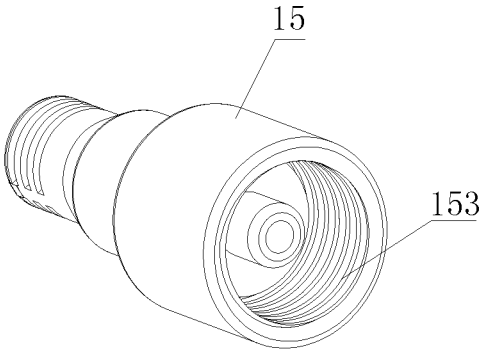
FIG. 6 is a schematic perspective view of a second connection head provided by the embodiment of the application.
Figure 7:
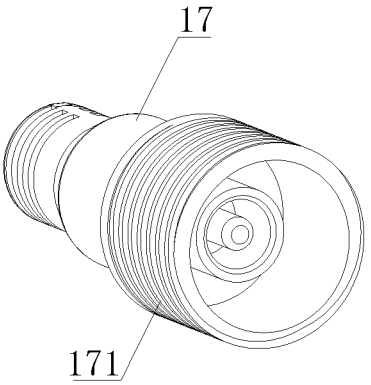
FIG. 7 is a schematic perspective view of a function head provided by the embodiment of the application.

Specifically, as shown in FIG. 1, FIG. 4 and FIG. 6, the first connection head 14 is provided with a connection body 141 and a first conductive group 142 arranged inside the connection body 141; the second connection head 15 is provided with a connection cap 151 and a second conductive group 152 arranged inside the connection cap 151 and electrically connected in a pluggable way with the first conductive group 142; a connection component configured to detachably connect the connection body 141 with the connection cap 151 is arranged between the connection body 141 and the connection cap 151. The first conductive group 142 and the second conductive group 152 are matched with each other and convenient to be connected, and can achieve a reliable electrical connection, thereby ensuring the stability of the electrical connection between the illumination linkage units 1. By the arrangement of the connection component, two illumination linkage units 1 to be connected can be connected conveniently and stably, and can also be detached easily. The connection component can be of a thread connection structure or a snap structure, or other quick-release structures which can be connected quickly.

Specifically, as shown in FIG. 1, FIG. 4, FIG. 6 and FIG. 7, in this embodiment, the connection component is provided with a first external thread 143 arranged on the connection body 141 and a first inner thread 153 arranged on the connection cap 151, and the first external thread 143 is connected to the first inner thread 153. The connection is stable and easy to disassemble and assemble through the thread connection. The degree of tightness of the connection can be adjusted freely and conveniently. For thread connection, the function head 17 is configured with a second external thread 171 which is threadedly matchable and connectable with the first inner thread 153 arranged on the connection cap 151 to realize the connection. The function head 17 is of a standard type and can be connected in match to the connection cap 151 arranged on each illumination linkage unit 1, which possesses a good interchangeability and ensures the convenience to use. Furthermore, the structure of the connection component can be changed. For example, if the connection body 141 is provided with an inner thread, the connection cap 151 is provided with an external thread correspondingly, and the function head 17 will correspondingly be changed to an inner thread. The configurations are various, and are not limited herein.

Specifically, the connection component is provided with at least two fixture blocks (not shown) arranged on the connection body 141 and at least two fixture hooks (not shown) arranged on the connection cap 151. The fixture hooks are hooked on the fixture blocks. The fixture hooks are hook members with the function of elastic deformation. When the first connection head 14 is to be connected to the second connection head 15, the fixture hooks can be deformed under pressures, such that the fixture hooks are hooked on the fixture blocks to realize connections. In disconnection, the fixture hooks can be deformed more under further pressures, so that the first connection head 14 and/or the second connection head 15 are/is turned, and the fixture hooks and the fixture blocks are misplaced, thereby realizing the disconnection. Such connections are convenient, stable, and have great utility. Furthermore, on the premise of a high stability of connection, the numbers of the fixture blocks and the fixture hooks should be decreased as much as possible so as to lower the cost of manufacture. Therefore, in this embodiment, three fixture blocks and three fixture hooks are arranged equidistantly, thereby ensuring the stability of connection. Furthermore, when the snap-structured connection is adopted, at least one hanging hook configured to hook the fixture blocks can be arranged correspondingly on the function head 17. The hanging hook can have the same structure as the fixture hook and can also generate elastic deformation, the connection and disconnection manners of the hanging hook can be similar to that of the fixture book, and therefore do not be described herein.

Furthermore, as shown in FIG. 4, the second conductive group 152 is sheathed with a sealing ring 18 for waterproofing. By the sealing ring 18, the junction can be sealed safely, and the electrical connection will not be affected due to the entrance of impurities such as dust and moisture, thereby ensuring the reliability to use.

Furthermore, as shown in FIG. 1 and FIG. 5, the illumination linkage unit 1 is further provided with a transparent soft protective jacket 19, through which the wire 11 is passed. The soft protective jacket 19 not only makes the illumination linkage unit 1 be winded and collected more easily, but also protects the wire 11 and each of the illuminating members 12 by preventing the wire 11 and each of the illuminating members 12 from contacting the outside directly, thereby ensuring the reliability to use. At the same time, the emitted light will look softer through the soft protective jacket 19 of each illuminating member 12 because of the optical conductivity of the transparent soft protective jacket 19, thereby improving the illuminative appearance of the illumination linkage unit 1. Furthermore, the transparent soft protective jacket 19 can be set into various colors, thereby further improving the appearance.

Specifically, as shown in FIG. 1 and FIG. 5, the periphery of each of the positive wire 111, the negative wire 112 and the return wire 113 is provided with a protective layer 114 for insulation. Thus, it is ensured that the wires are insulated from each other and prevented from being short circuited, and a reliable electric conduction can also be ensured.

Preferably, the protective layer 114 is made of silica gel, silicon cement or insulation varnish. These materials have reliable insulation and can be widely drawn, so that the manufacturing cost can be decreased.

Specifically, as shown in FIG. 2, the illuminating member 12 is covered with sealant 121. Since each electrical linkage group 13 is provided therein with at least one illuminating member 12, each illuminating member 12 can be covered individually or all illuminating members 12 can be covered integrally as a whole. By the arrangement of the sealant 121, each illuminating member 12 can be isolated from outside and form a sealed space, thereby preventing the illuminating member 12 from environmental pollutions and damages and extending its service life. Furthermore, the numbers of the illuminating members 12 arranged in each electrical linkage group 13 are equal, thereby facilitating the distribution of the voltage.

Figure 8:
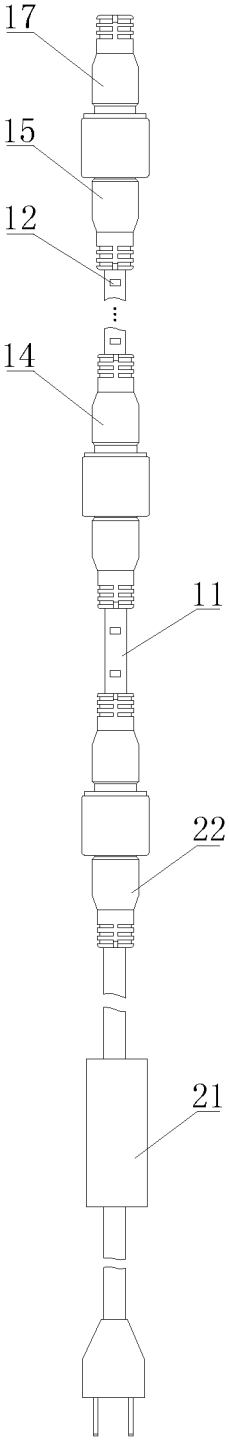
FIG. 8 is a schematic view of a linear illumination provided by the embodiment of the application.

As shown in FIG. 1 and FIG. 8, one embodiment of the application further provides a linear illumination, which comprises a driving power 21 configured to drive the illumination linkage unit 1 to illuminate, and the above-mentioned illumination linkage unit 1. The driving power 21 is provided therein with a constant current component (not shown), and the driving power 21 is provided with a power supply connection head 22 detachably connected with the first connection head 14. The driving power 21 is a low-voltage power, and may provide relative low constant current through the constant current component, so that the current values of each illuminating member 12 in the linear illumination are equal, thereby ensuring that the brightness levels are even, no light-and-dark areas occurs, and the appearance is beautiful. Since the current values are constant and low, no heating area will occur at the end close to the power, thereby improving the appearance and safety.

The specifications stated above are just preferred embodiments of the application, which are not intended to limit the application. Any amendments, alternatives or improvements within the spirit and principle of the application should be deemed as included in the scope of the application.

What is claimed is:

1. An illumination linkage unit, comprising a wire assembly and an illuminating member electrically connected to the wire assembly, wherein the wire assembly comprises at least one positive wire, at least one negative wire, and at least one return wire; the positive wire and the negative wire are arranged in pairs, and there are multiple spaced electrical linkage groups formed between the positive wire and the negative wire; each former electrical linkage group is connected in series or in parallel with its later electrical linkage group; the return wire extends from a first electrical linkage group to a last electrical linkage group, and is electrically connected with the negative wire of the last electrical linkage group; Each illuminating member is provided therein with an electrical linkage group; the each illuminating member provided in the electrical linkage group is electrically connected to the positive wire and negative wire respectively; the positive wire of the first electrical linkage group and the return wire are electrically connected to a first connection head, and the negative wire of the last electrical linkage group and the return wire are electrically connected to a second connection head which is matchable and connectable with the first connection head; the second connection head is detachably connected with a function head configured to connect the negative wire with the return wire.

2. The illumination linkage unit of claim 1, wherein the positive wire, the negative wire and the return wire are lined side by side in bundle.

3. The illumination linkage unit of claim 2, wherein an adhesive layer configured to adhere the positive wire, the negative wire and the return wire together is arranged among the positive wire, the negative wire and the return wire.

4. The illumination linkage unit of claim 1, wherein the illuminating member is an LED bead.

5. The illumination linkage unit of claim 1, wherein the first connection head is provided with a connection body and a first conductive group arranged inside the connection body; the second connection head is provided with a connection cap and a second conductive group arranged inside the connection cap, and electrically connected in a pluggable way with the first conductive group; a connection component configured to detachably connects the connection body with the connection cap is arranged between the connection body and the connection cap.

6. The illumination linkage unit of claim 5, wherein the connection component is provided with a first external thread arranged on the connection body and a first inner thread arranged on the connection cap; the first external thread is connected with the first inner thread.

7. The illumination linkage unit of claim 5, wherein the connection component is provided with at least two fixture blocks arranged on the connection body and at least two fixture hooks arranged on the connection cap; the fixture hooks are hooked on the fixture blocks.

8. The illumination linkage unit of claim 7, wherein the number of the fixtures is three, the number of the fixture hooks is also three, and the fixture blocks and the fixture hooks are arranged equidistantly.

9. The illumination linkage unit of claim 7, wherein the function head is provided thereon with a hanging hook configured to hook the fixture blocks.

10. The illumination linkage unit of claim 6, wherein the function head is configured with a second external thread which is threadedly matchable and connectable with the first inner thread arranged on the connection cap.

11. The illumination linkage unit of claim 5, wherein the second conductive group is sheathed with a sealing ring for waterproofing.

12. The illumination linkage unit of claim 1, wherein the illumination linkage unit further includes a transparent soft protective jacket; the wire is sleeved in the transparent soft protective jacket.

13. The illumination linkage unit of claim 1, wherein peripheries of the positive wire, the negative wire and the return wire are all provided with protective layers for insulation.

14. The illumination linkage unit of claim 1, wherein the illuminating member is covered with sealant.

15. A linear illumination comprising a driving power supply configured to drive an illumination linkage unit to illuminate and further comprising the illumination linkage unit of claim 1; wherein the driving power supply is provided therein with a constant current component, and the driving power supply is further provided with a power supply connection head detachably connected with the first connection head electrically.

* * * * *